United States Patent [19]

Bell et al.

[11] Patent Number: 4,885,967

[45] Date of Patent: Dec. 12, 1989

[54] LASER ALIGNMENT DEVICE FOR SAWMILLS

[75] Inventors: David C. Bell, Baltimore; Joe Smith, Whitehall, both of Md.

[73] Assignee: J. Gibson McIlvain Company, White Marsh, Md.

[21] Appl. No.: 236,244

[22] Filed: Aug. 25, 1988

[51] Int. Cl.[4] ..... B27B 5/29; B27B 5/04

[52] U.S. Cl. ..... 83/520

[58] Field of Search ..... 83/520, 521, 522, 471.2, 83/486, 488; 33/348; 144/376, 378

[56] References Cited

U.S. PATENT DOCUMENTS

| | | | |
|---|---|---|---|
| 1,476,238 | 12/1923 | Bump | 83/520 |
| 1,786,925 | 12/1930 | Wiegelmann | 83/520 |
| 1,804,764 | 5/1931 | Grant | 83/520 |
| 2,510,471 | 6/1950 | Horstkotte | 83/520 |
| 2,806,492 | 9/1957 | Becker | 83/520 |
| 3,381,729 | 5/1968 | Dunn | 144/376 |
| 3,496,814 | 2/1970 | Bessim | 83/520 |
| 4,224,853 | 9/1980 | Ruotsalainer | 83/520 |
| 4,257,297 | 3/1981 | Nidbella | 83/471 |
| 4,468,992 | 9/1984 | McGeehee | 83/56 |
| 4,503,740 | 3/1985 | Brand et al. | 83/521 |
| 4,676,130 | 6/1987 | Nutt | 83/155 |
| 4,805,499 | 2/1989 | Chiang | 83/520 |

*Primary Examiner*—Douglas D. Watts
*Assistant Examiner*—Scott A. Smith
*Attorney, Agent, or Firm*—Shlesinger & Myers

[57] ABSTRACT

A laser alignment device which can be detachably mounted on a lumber cutting machine for assisting an operator in properly aligning a workpiece before cutting it into strips of desired widths. The device includes a frame which supports laser devices for projecting cutting-lines on the workpiece, which are visible to the operator. The laser devices are movable on the frame and their positions may be adjusted independent of each other so as to be in alignment with the respective saw blades disposed within the lumber cutting machine. The device further includes devices for locking the desired positions of the laser devices on the frame.

8 Claims, 4 Drawing Sheets

FIG. 3
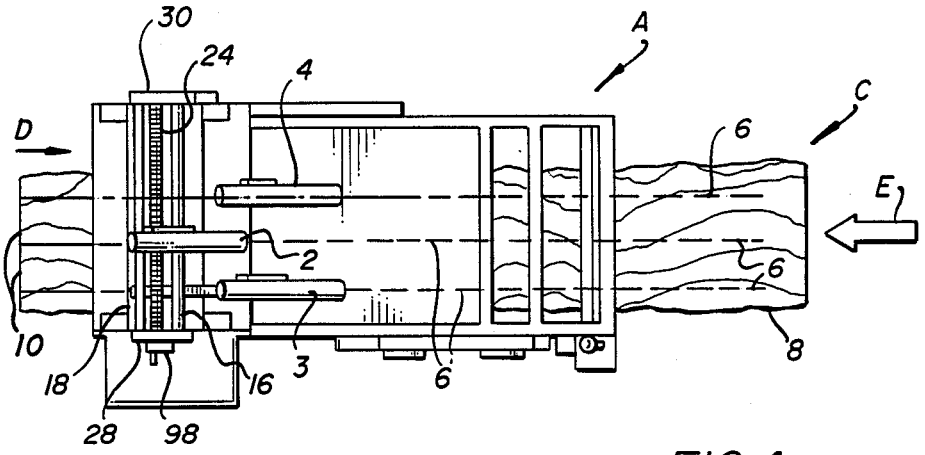
FIG. 4
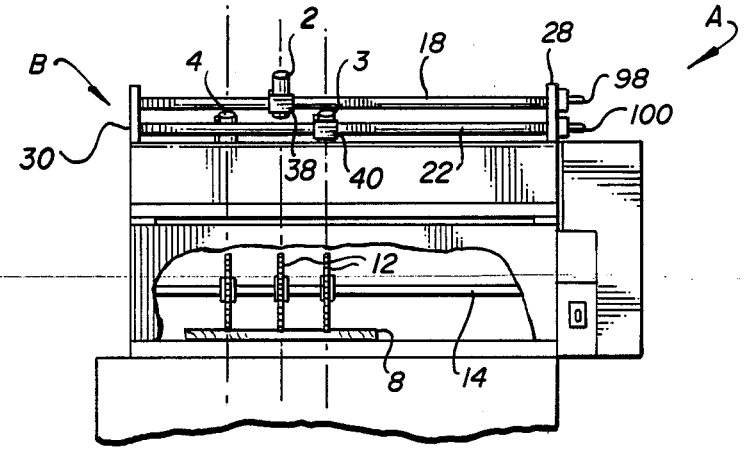
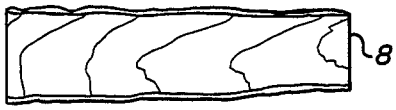
FIG. 5
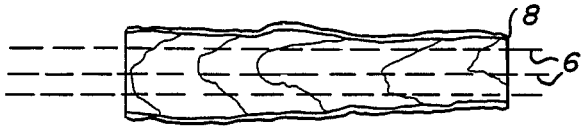
FIG. 6
FIG. 7
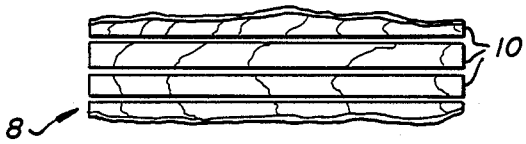

60
58
100
98
28
F
30
32
20
36
16
18
24
40
12
2
102
34
35
B
54
56
11
50
38
52
48
110

LASER ALIGNMENT DEVICE FOR SAWMILLS

FIELD AND HISTORICAL BACKGROUND OF THE INVENTION

The present invention is directed to a laser alignment device for sawmills, and more particularly to a device which may be detachably mounted on a lumber cutting machine for the proper alignment of the workpieces.

In sawmill operations, the logs are typically cut about a number of parallel, axial planes to produce a number of irregularly shaped planks, generally referred to as "cants". Generally, the length of the cants depends upon the length of the log from which is it cut, and would be the same for all cants cut from the same log. However, the width of each cant, will vary depending on the particular section of the log which was cut. For example, the cants which are obtained from the central core of the log will be much wider than those obtained from the edges of the log. Additionally, the cants will taper in one direction due to the decreasing diameter of the tree towards its top. Typically, the cants have two parallel, cut faces resulting from the initial ripsawing of the log, and a pair of irregular edges corresponding to the external perimeter of the log. The rounded or irregular edges are referred to as "wane" edges, and are generally removed before finish-cutting the cant into boards of predetermined widths.

For those involved in the processing of the cants into boards, an important concern has been to maximize the recovery of boards from a log or the cant. One way of doing this is to minimize the wane edges which must be removed in order to obtain the board. In the lumber industry, this is obtained by carefully edging the cants along a straight line about the lateral edges of the cants. However, it has been observed that, frequently, it is difficult to determine the exact locations of the saw blades disposed inside the lumber cutting machine, and therefore, it is difficult for the operator to align precisely a cant, to thereby minimize the amount of scrap material removed therefrom.

Conventionally, a light source or the like is used to cast a shadow on the workpiece to indicate the position of the saw blade in relation thereto. However, this method is not effective in a lumber cutting machine in which the saw blades are hidden within the machine, or positioned such that it is difficult for the operator to determine the precise location of the cutting edges of the blades in relation to the board. In addition, where an incoming board-in-motion has to be cut into multiple narrow strips, it becomes critical that the operator know exactly where the board is going to be cut into the corresponding strips. The examples of conventional devices of this type are disclosed in U.S. Pat. Nos. 4,257,297; 4,468,992; 4,503,740; and 4,676,130.

In view of the above, there is a need for an alignment device which assists the operator to align precisely the cants in order to maximize the total useful width of the cant and minimize the scrap material removed therefrom.

OBJECTS AND SUMMARY OF THE INVENTION

The principal object of the present invention is to provide a laser alignment device for sawmills which may be detachably mounted on a lumber cutting machine.

An object of the present invention is to provide a laser alignment device which is compact and easy to manufacture and ship to the users.

An additional object of the present is to provide a laser alignment device for sawmills which facilitates the operator to align precisely a cant or workpiece thereby maximizing the output.

Another object of the present is to provide a laser alignment device for sawmills which facilitates the operator to align a cant or workpiece in such a manner so as to minimize the scrap material removed.

Yet another object of the present invention is to provide a laser alignment device for sawmills wherein the laser sources may be aligned independent of each other and with the circular saw blades which are disposed within the lumber cutting machine.

Still another object of the present invention is to provide a laser alignment device for sawmills in which the laser sources translate independent of each other, and independent of the saw blades disposed within the lumber cutting machine.

Still yet another object of the present invention is to provide a laser alignment device in which the laser sources are positioned at a very slight distance from each other such that the device can be made as a compact unit.

A further object of the present invention is to provide a laser alignment device for sawmills wherein the laser beams emitted by the respective laser sources are cast upon the incoming cant or workpiece, thereby marking it with the lines about which it is going to be cut by the lumber cutting machine.

Yet a further object of the present invention is to provide a laser alignment device for sawmills wherein the positions of the laser sources may be adjusted so to be in alignment with the positions of the saw blades disposed within the lumber cutting machine.

In summary, the object of the present invention is to provide a laser alignment device for precisely aligning a workpiece or cant in order to maximize the usable portion and minimize the scrap material removed therefrom.

BRIEF DESCRIPTION OF THE DRAWINGS

The above and other objects and advantages and novel features of the present invention will become apparent from the following detailed description of the preferred embodiment of the invention illustrated in the accompanying drawings, wherein:

FIG. 3 is a partial top plan view of the lumber cutting machine;

FIG. 4 is a partial end view of the lumber cutting machine, with a portion broken away to show the positions of the saw blades relative to the laser sources;

FIG. 5 illustrates a cant or workpiece which is to cut by the lumber cutting machine;

FIG. 6 illustrates the cant or workpiece with the laser beams projected on it to indicate the lines along which it is to be cut by the machine;

FIG. 7 illustrates the cant or the board after it has been cut;

DETAILED DESCRIPTION OF THE INVENTION

Figure 1:
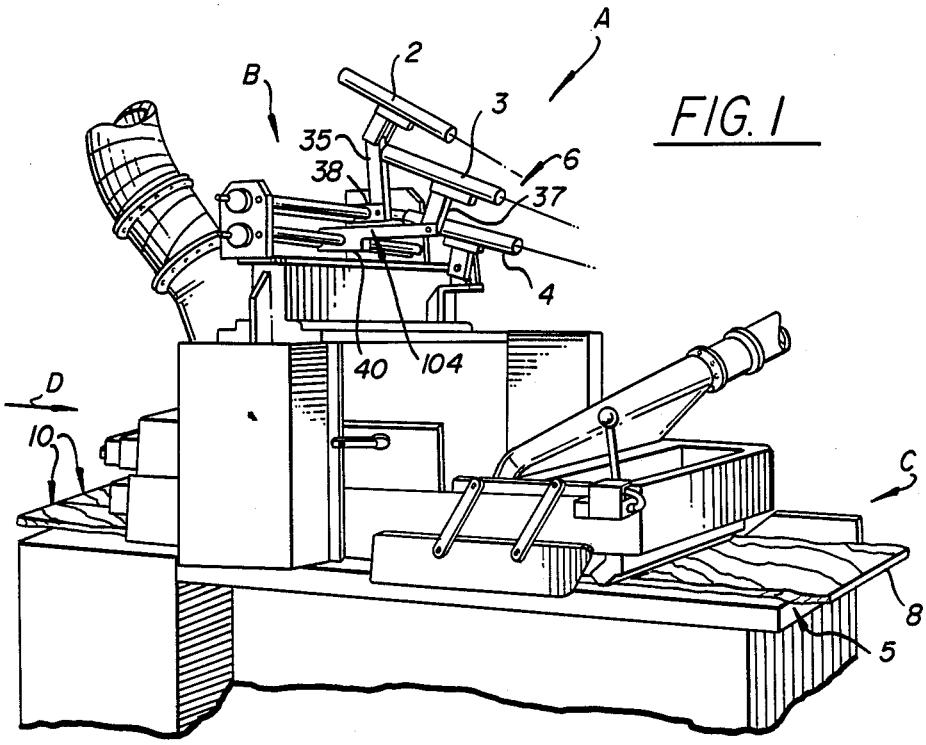
FIG. 1 is a perspective view of a lumber cutting machine showing a laser alignment device of the present invention mounted thereon.
Figure 2:
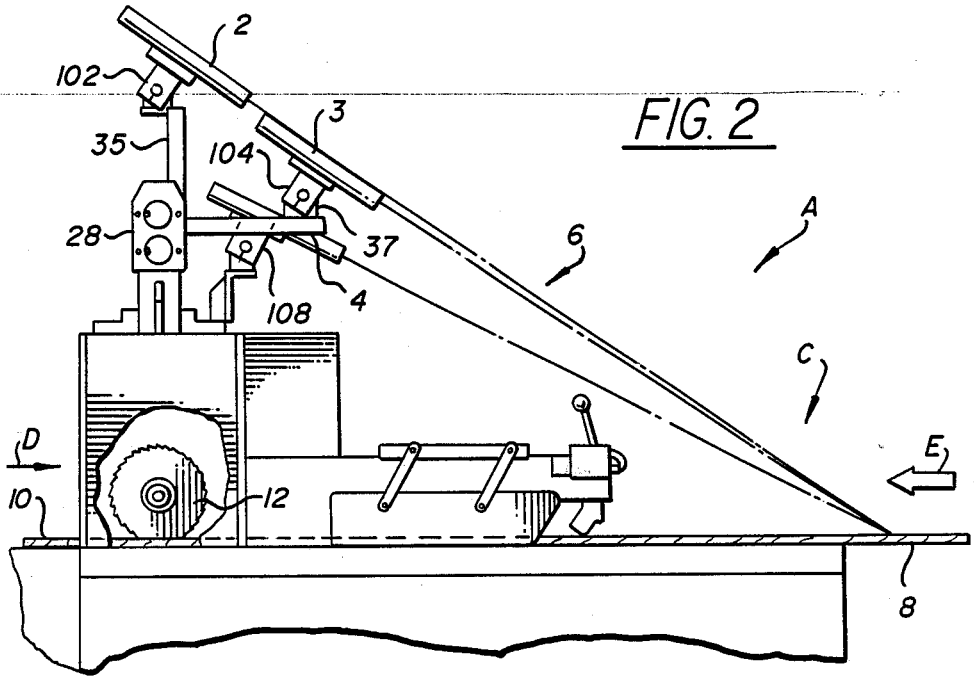
FIG. 2 is a partial side view of the lumber cutting machine shown in FIG. 1, with a portion broken away to show the saw blades.

As best shown in FIGS. 1 and 2, a lumber cutting machine A includes a laser alignment device B mounted thereon. The laser alignment device B is mounted at a convenient position atop lumber cutting machine A such that laser sources 2 and 3 forming a part of device B, as well as laser source 4 mounted on the lumber cutting machine A, together generally face the front end C of the lumber cutting machine A. The laser sources 2, 3, and 4 project laser beams 6 on a cant or workpiece 8, coming along a conveyor 5.

As shown in FIGS. 2 and 3, workpiece 8 is advanced through the front end C of lumber cutting machine A by an operator (not shown), and is received at the rear end D of machine A by another operator (not shown), after it has been cut into strips 10. (It should be noted that only the parts of the lumber cutting machine A which are necessary for a clear understanding of the present invention have been described herein).

The lumber cuting machine A includes a set of conventional saw blades 12 which are rigidly mounted on a shaft 14. The shaft 14 in turn is operably connected with a motor (not shown) for causing the rotation of the saw blades 12. Typically, shaft 14 may be removed from the lumber cutting machine A and the positions of saw blades 12 relative to each other may be varied, as desired. It should be noted that, preferably, the total number of saw blades 12 corresponds to the total number of laser sources mounted on laser alignment device B and on the lumber cutting machine A, in order that each blade may be separately aligned with a corresponding laser source, shown in FIG. 4.

As best shown in FIGS. 8–12, the laser alignment device B preferably includes a frame F having two upper support rods 16 and 18 running generally parallel to each other, and two lower support rods 20 and 22 running generally parallel to each other and directly below corresponding upper rods 16 and 18, respectively. A screw-threaded upper rod 24 is disposed in between upper rods 16 and 18 and extends generally parallel thereto. Similarly, a lower screw-threaded rod 26 is also positioned between the lower rods 20 and 22. Upper and lower screw-threaded rods 24 and 26 run generally parallel to each other. Preferably, upper rods 16 and 18, and lower rods 20 and 22 are smooth surfaced. The frame F further includes left and right end plates 28 and 30, respectively, and a bottom support plate 32 which provide strength and contribute to its overall structure.

The upper rods 16, 18 and 24 together support a laser source 2, and the lower rods 20, 22 and 26, together support another laser source 3, on the corresponding upper and lower support brackets 34 and 36, respectively. The upper and lower support brackets 34 and 36, include upper and lower base members 38 and 40, and upper and lower support arms 35 and 37, respectively.

Figure 11:
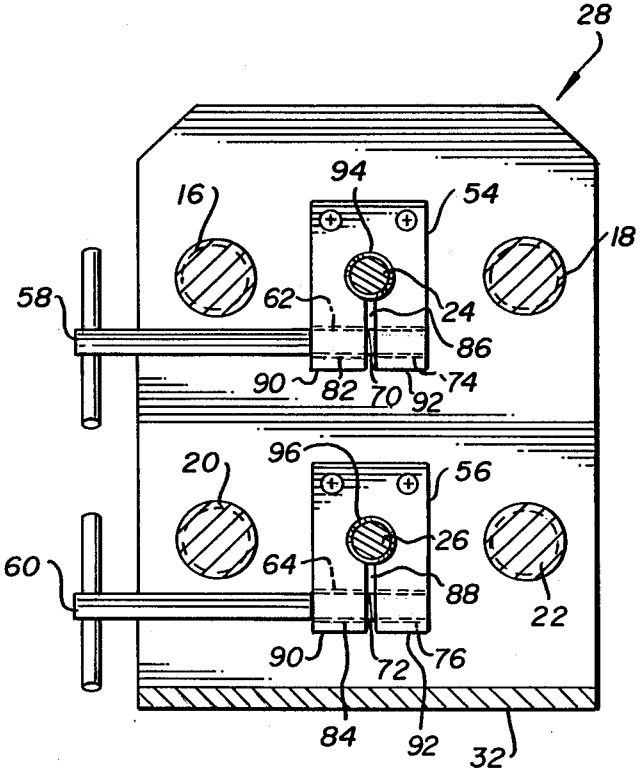
FIG. 11 is an enlarged view taken along line 11—11 of FIG. 8.

As shown in FIG. 11, the lower base member 40 includes three laterally disposed holes 42, 44, 46, which correspond to lower rods 20, 22 and 26. Similarly, the upper base member 38 includes three laterally disposed holes 48, 50, and 52 which correspond to three upper rods 16, 18, and 24. The upper and lower holes 46 and 52 are screw-threaded, and the upper holes 42 and 44, and lower holes 48 and 50 have smooth surfaces.

In the assembled position, the upper holes 48 and 50 receive upper rods 16 and 18, respectively, and the lower holes 42 and 44 receive the lower rods 20 and 22, respectively. The upper and lower screw-threaded rods 24 and 26 are likewise received in upper and lower screw-threaded holes 52 and 46, respectively. As it will be clear to those of ordinary skill in the art, rods 16, 18 and 20, 22, stabilize their respective upper and lower support brackets 34 and 36, respectively. And, the upper and lower screw-threaded rods 24 and 26 are used to translate the laser alignment device B thereon.

Figures 8, 9, 10:
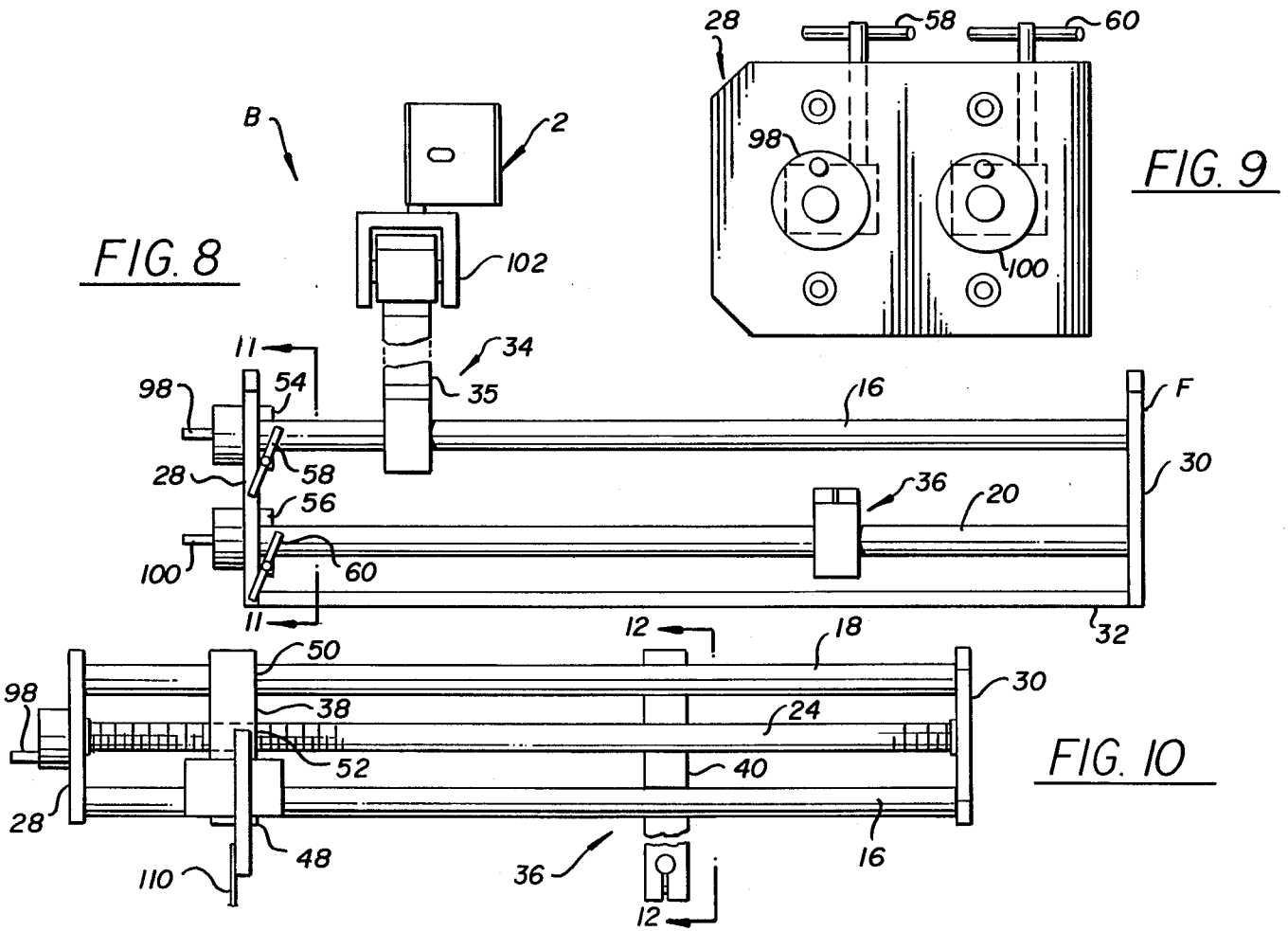
FIG. 8 is an enlarged, front elevational view of the laser alignment device shown detached from the lumber cutting machine.
FIG. 9 is a partial, enlarged, end view of the laser aligment device shown in FIG. 8.
FIG. 10 is a partial top plan view of the laser alignment device shown in FIG. 8.
Figure 12:
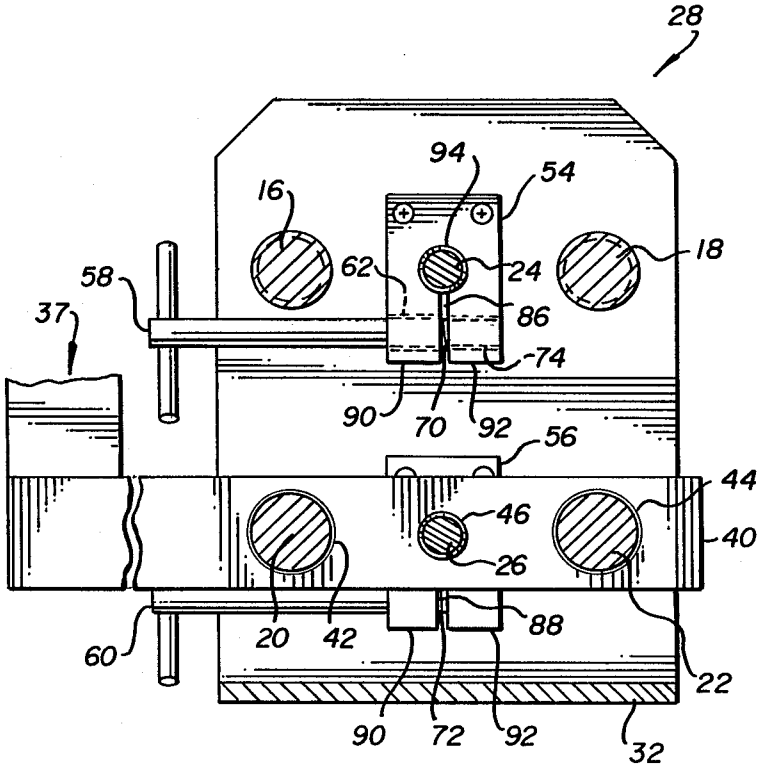
FIG. 12 is an enlarged view taken along line 12—12 of FIG. 10, showing partially only the lower support bracket.

In order to lock the respective positions of laser sources 2 and 3 on the frame F, upper and lower clamp plates 54 and 56 are provided adjacent left end plate 28, shown in FIGS. 8, 11 and 12. Clamp plates 54 and 56 are provided with clamp handles 58 and 60, which are received in respective holes 62 and 64.

The clamp holes 62 and 64 are partially screw-threaded, and similarly, clamp handles 58 and 60 are also partially screw-threaded such that screw-threaded portions 70 and 72 of clamp handles 58 and 60 are received in the screw-threaded portions 74 and 76 of holes 62 and 64, and freely slide in smooth portions 82 and 84 of clamp holes 62 and 64. The threaded portions 74 and 76 and smooth portions 82 and 84 are separated by vertically extending clearance spaces 86 and 88 so that when clamp handles 58 and 60 are screwed into the corresponding screw-threaded portions 74 and 76, the sections 90 and 92 of clamp plates 54 and 56 are drawn closer together thereby reducing clearance spaces 86 and 88 and tightly engaging rods 24 and 26 extending through holes 94 and 96 clamp plates 54 and 56.

Two handles 98 and 100 provided on the exterior of the left end plate 28 are connected with upper nd lower screw-threaded rods 24 and 26, respectively, and assist the operator to adjust manually the relative positions of laser alignment devices B on frame F.

The upper and lower support arms 35 and 37 are each connected with generally U-shaped pivotable support members 102 and 104, which support laser emitting devices 2 and 3 mounted atop thereof. Similarly, laser emitting device 4 is also mounted on a pivotable support member 106.

As shown in FIGS. 1 and 4, the clearance space 108 between vertically spaced upper and lower base members 38 and 40 is of small magnitude and allows them to pass each other without obstruction. In addition, by positioning the support arms 35 and 37 one above the other, the entire laser alignment device B can be made as a compact unit for easy shipping and handling. Preferably, lower base member 40 extends generally horizontally to a point farther than upper base member 38 towards front end C of lumber cutting machine A, and upper support arm 35 extends vertically upwardly higher than lower support arm 37 such that laser source 2 mounted on arm 35 is situated higher on the machine A than the laser source 3 mounted on the lower support arm 37. On the other hand, the laser source 4, mounted on the lumber cutting machine A, is situated lower and in front of both laser sources 2 and 3. It should be apparent that the relative positions of laser source 2, 3 and 4, can be varied to accommodate the operator's desires and specifications.

A light shield 110 or the like maybe mounted in relation to each of the laser sources 2, 3 and 4 to avoid any interference from other light to the laser beams 6.

USE AND OPERATION

In use, the operator selects or adjusts the relative positions of saw blades 12 on the shaft 14. By actuating handles 98 and 100, the operator may then adjust the positions of laser sources 2 and 3 (laser source 4 remaining fixed at one position on the lumber cutting machine A) such that they are in alignment with corresponding blades 12 down below. Once the laser sources 2 and 3 are aligned, clamp handles 58 and 60 may then be actuated to lock their positions on the frame F. Since the laser sources 2–4 are in alignment with corresponding saw blades 12, the laser beams 6 emitted and cast upon the workpiece 8 would indicate the exact lines about which the blades 12 will engage the workpiece 8, thereby cutting it into strips 10, FIGS. 4–7.

By using the present laser alignment device, the operator exactly knows the locations of the cutting lines on the workpiece 8 before advancing it through lumber cutting machine A. Therefore, the maximum width of the workpiece 8 is used by minimizing the scrap material removed therefrom. In other words, if a workpiece has more width than that which is necessary for obtaining the desired number of strips with desired widths, too much scrap material would removed. On the other hand, if a workpiece has insufficient width to produce the desired number of strips with desired widths, the strips produced may not be usable as one or more of them may not have sufficient width. However, by advancing the workpieces having adequate widths for producing strips of desired widths, the operator can reduce the scrap material, or eliminate producing strips of insufficient widths.

While this invention has been described as having a preferred design, it should be understood that it is capable of further modifications. This application, is therefore intended to cover any variations, uses, and/or adaptations of the invention following in general the principles of the invention and including such departures from the present disclosure as have come within known or customary practice in the art to which this invention pertains, and as may be applied to the essential features hereinbefore set forth and fall within the scope of this invention or the limits of the claims appended hereto.

What is claimed is:

1. A laser alignment device adapted to be mounted on a lumber cutting machine, comprising:

(a) frame means;

(b) said frame means including a plurality of vertically spaced mounting means;

(c) said mounting means each including a plurality of generally parallel, laterally spaced support rods and a screw-threaded rod positioned between said support rods;

(d) laser means adjustable mounted on each said mounting means such that one of said laser means translates over and independent of another of said laser means;

(e) each said laser means including a laser source and bracket means;

(f) each said bracket means including a plurality of laterally spaced first holes for slidably receiving said support rods, and a screw-threaded second hole for rotatably receiving said screw-threaded rod therein;

(g) each said bracket means including a support arm;

(h) said support arms being positioned with respect to each other so as to permit said arms to pass each other during an adjustment of said laser means;

(i) said support arms comprising a first arm and a second arm;

(j) each of said first and second arms including a first end for supporting respective laser source and a second end operably connected with respective mounting means;

(k) said screw-threaded rod including rotating means disposed at one end thereof; and (l) wherein a rotation of said screw-threaded rod causes said bracket to be displaced axially.

2. The laser alignment device of claim 1, wherein:

(a) said support arms being spaced from each other by a slight distance.

3. The laser alignment device of claim 1, wherein:

(a) said first end of said first arm is positioned in front of said first end of said second arm.

4. The laser alignment device of claim 1, wherein:

(a) said first end of said second arm is positioned higher than said first end of said first arm.

5. The alignment device of claim 1, further comprising:

(a) means for locking the position of at least one of said laser means cooperating with its respective mounting means.

6. The laser alignment device of claim 1, in combination with a lumber cutting machine.

7. The laser alignment device of claim 6, wherein:

(a) said lumber cutting machine including:

(i) machine frame means including in and out openings;

(ii) conveyor means for advancing a workpiece along a path extending through said in opening and out through said out opening;

(iii) at least one saw-blade disposed generally vertically in said path between said in and out openings for cutting the workpiece;

(iv) the laser alignment device being positioned atop said machine frame means and emitting at least one laser beam generally toward said in opening for aligning the incoming workpiece according to a predetermined calculation; and (v) said laser means being translatable on respective mounting means independent of said saw-blade.

8. The laser alignment device of claim 7, wherein:

(a) a plurality of said saw-blades are disposed in said path;

(b) said saw-blades being substantially parallel to and spaced at a predetermined distance from each other;

(c) said laser means being positioned so as to be in alignment with said saw-blades; and (d) whereby the laser beams emitted by said laser means project cutting-lines on the workpiece.

* * * * *